United States Patent [19]

Jackson et al.

[11] 4,241,989

[45] Dec. 30, 1980

[54] DIAZO DEVELOPING APPARATUS

[75] Inventors: Richard W. Jackson, Barrington; Terry G. Seelenbinder, Elk Grove Village, both of Ill.

[73] Assignee: AM International, Inc., Los Angeles, Calif.

[21] Appl. No.: 3,202

[22] Filed: Jan. 15, 1979

[51] Int. Cl.[3] ..... G03D 7/00

[52] U.S. Cl. ..... 354/299; 354/300; 34/155

[58] Field of Search ..... 354/299, 300, 324; 355/27, 100, 106; 34/37, 155, 122; 432/60

[56] References Cited

U.S. PATENT DOCUMENTS

| | | | |
|---|---|---|---|
| 2,696,771 | 12/1954 | Frantz | 354/300 |
| 3,524,397 | 8/1970 | Hruby | 354/300 |
| 3,535,997 | 10/1970 | Blake | 354/300 |
| 3,565,523 | 2/1971 | Davis et al. | 354/300 |
| 3,710,708 | 1/1973 | Schuman et al. | 355/106 |
| 3,900,862 | 8/1975 | Bennett | 354/300 |
| 3,915,708 | 10/1975 | Zausmer et al. | 34/155 |
| 3,986,191 | 10/1976 | Ackermann et al. | 354/299 |

FOREIGN PATENT DOCUMENTS

| | | | |
|---|---|---|---|
| 1447848 | 1/1969 | Fed. Rep. of Germany | 354/300 |
| 2741326 | 3/1978 | Fed. Rep. of Germany | 354/300 |

*Primary Examiner*—L. T. Hix
*Assistant Examiner*—Alan Mathews
*Attorney, Agent, or Firm*—A. W. Karambelas; R. C. Curfiss; Russell L. Root

[57] ABSTRACT

Developing apparatus for diazo copy sheets is provided wherein the development chamber is supplied with anhydrous ammonia gas drawn from the region above the liquid ammonia solution in a reservoir. The ammonia gas is withdrawn from the reservoir by a pump which moves it into the development chamber. Due to the gas inflow inspired by the pump, the gas mixture in the chamber is caused to migrate out of the chamber by a return conduit whose outlet end is positioned below the surface of the liquid in the reservoir. The copy sheet transport means is a roll which occupies a mouth formed in a wall of the development chamber, and means are provided for effectively sealing the chamber contact margins against the roller to prevent escape of gas therefrom. The development chamber is arranged to snap over the roller and to be largely supported and positioned thereby. Means are also provided for forming and maintaining a pool of water in the chamber, and a heater within the transport roll aids in vaporizing the water to aid development while also guarding against undue moisture absorption by a copy sheet being developed.

8 Claims, 5 Drawing Figures

DIAZO DEVELOPING APPARATUS

BACKGROUND OF THE INVENTION

In the art of developing diazotype copy sheets with gaseous ammonia various approaches have been used to provide the ammonia gas and to secure its effective and uniform application to the copy sheet surface. Some of these are rather complex and expensive, and others, while simpler in concept and thus less costly, are not quite so efficient either in development speed or uniformity of development results. This trade-off between cost and effectiveness has always been a problem, and there is in the art an ongoing experimental effort seeking to reach a simpler constuction without impairing development efficiency.

One method of development involves the introduction of anhydrous ammonia gas into a developing chamber through which the copy sheet is passing, and one arrangement for this purpose is illustrated in U.S. patent to Bennett U.S. Pat. No. 3,900,862. In this patent one pump is used to slightly pressurize a reservoir of aqueous ammonia by pumping a gaseous medium into the same below the level of the liquid therein. This causes the anhydrous ammonia gas above the liquid to move out of the reservoir through a supply duct to the development chamber which is connected by an exhaust duct with the pump intake to complete the circuit. A second exhaust duct leads to a second pump via a control or "vacuum surge" chamber, and thence through a neutralizing bath to the atmosphere. The control chamber includes a relief valve designed to prevent the second pump from drawing anything greater than a constant predetermined vacuum in the development chamber.

SUMMARY OF THE INVENTION

The present invention provides an arrangement, simpler in nature than the device described above. In the present case there is a pump drawing anhydrous ammonia gas from above the liquid level in an aqueous ammonia reservoir, and moving the same into the development chamber, from which gas is exhausted through a line which provides a path directly to the reservoir and leads beneath the surface of the liquid therein. All of the ammonia gas is thus recirculated and waste of ammonia is essentially avoided.

In addition, a simplified development chamber arrangement is provided. The means used to transport the copy paper through the development area is an elongate roll or cylinder with a matte finish which establishes driving contact with the surface of the copy sheet. This means has been previously known, and was chosen as offering the best basis for simplicity in the overall construction. The development chamber is an elongate container having a mouth running lengthwise of the container at one side. This mouth serves to receive and embrace the roll, and placed across the mouth is a flexible sheet of non-friction plastic material which is dimensioned to lie snugly against the roll when the latter is in place. The longitudinal edges of the mouth carry resilient sealing strips, and each end of the container provides a sealing arrangement partially encircling the roll.

The plastic sheet is perforated to permit access of the ammonia in the chamber to the surface of a copy sheet which is being transported by the roll.

The developing chamber is made of thin resilient material, such as sheet aluminum, and is so constructed that the walls at the margins of the mouth allow the chamber to merely snap over the roll, embracing slightly more than a semicircumference thereof, and to be supported thereby.

A further aspect of the invention relates to providing moisture for cooperation with ammonia gas in order to enhance development quality and speed, and to do so in a very simple fashion. This is done by providing shallow water bath in the bottom of the development chamber. An inlet fitting in the chamber wall is coupled by a flexible conduit with a filling and level determining cup attached to the front of the machine where the operator can readily maintain the proper water level as needed.

Finally, the effectiveness of the combination to secure uniform high speed development is further enhanced by a heater element disposed axially within the transport roll. When energized this heater provides the combined effect of (1) heating the chamber sufficiently to increase vaporization of the moisture in the bottom of the chamber, and (2) applying a thermal pressure such that the support paper of the copy sheet, which is closest to the heat source, is largely prevented from absorbing excessive moisture and is thus prevented from becoming limp and difficult to handle. However, this still allows the moisture in the chamber atmosphere to act against the coated surface of the sheet to enhance the developing action of the anhydrous ammonia.

Another way of stating the importance of mositure application at the time of development is that this relates in part to the copy paper supplies being used with the machine. That is to say, copy paper coatings can be formulated for special reliability and long shelf life, but these are rather slow acting in the development phase. However, if their ammonia development is accompanied by moisture vapor, the speed and effectiveness of the developing action is still not impaired, regardless of such special coating formulation.

DESCRIPTION OF THE PREFERRED EMBODIMENT

Figures 1, 4:
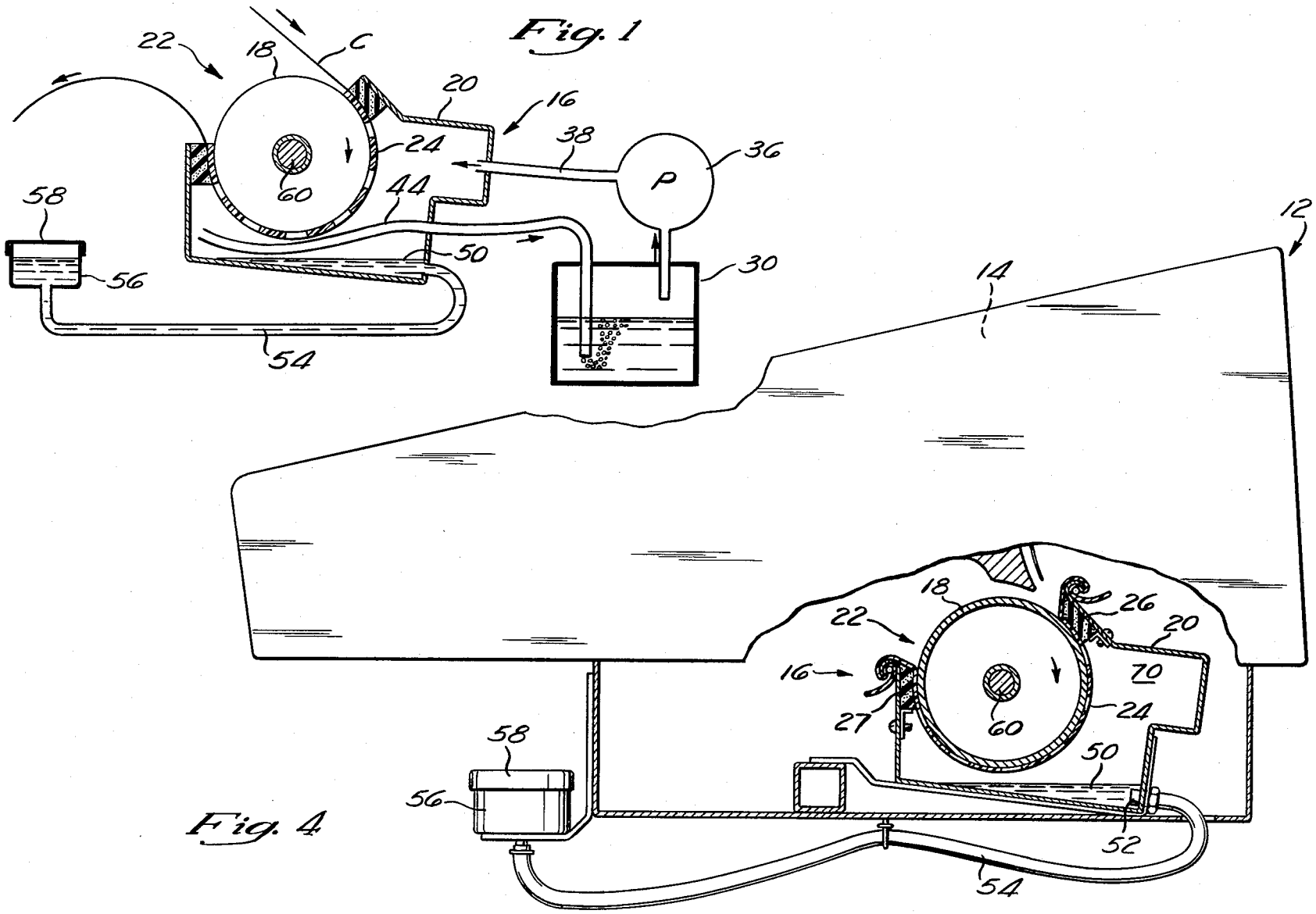
FIG. 1 is a diagrammatic section showing the arrangement of a diazo developing system according to the invention.
FIG. 4 is an end elevation, partially in section, taken substantially on line 4—4 of FIG. 2.
Figure 2:
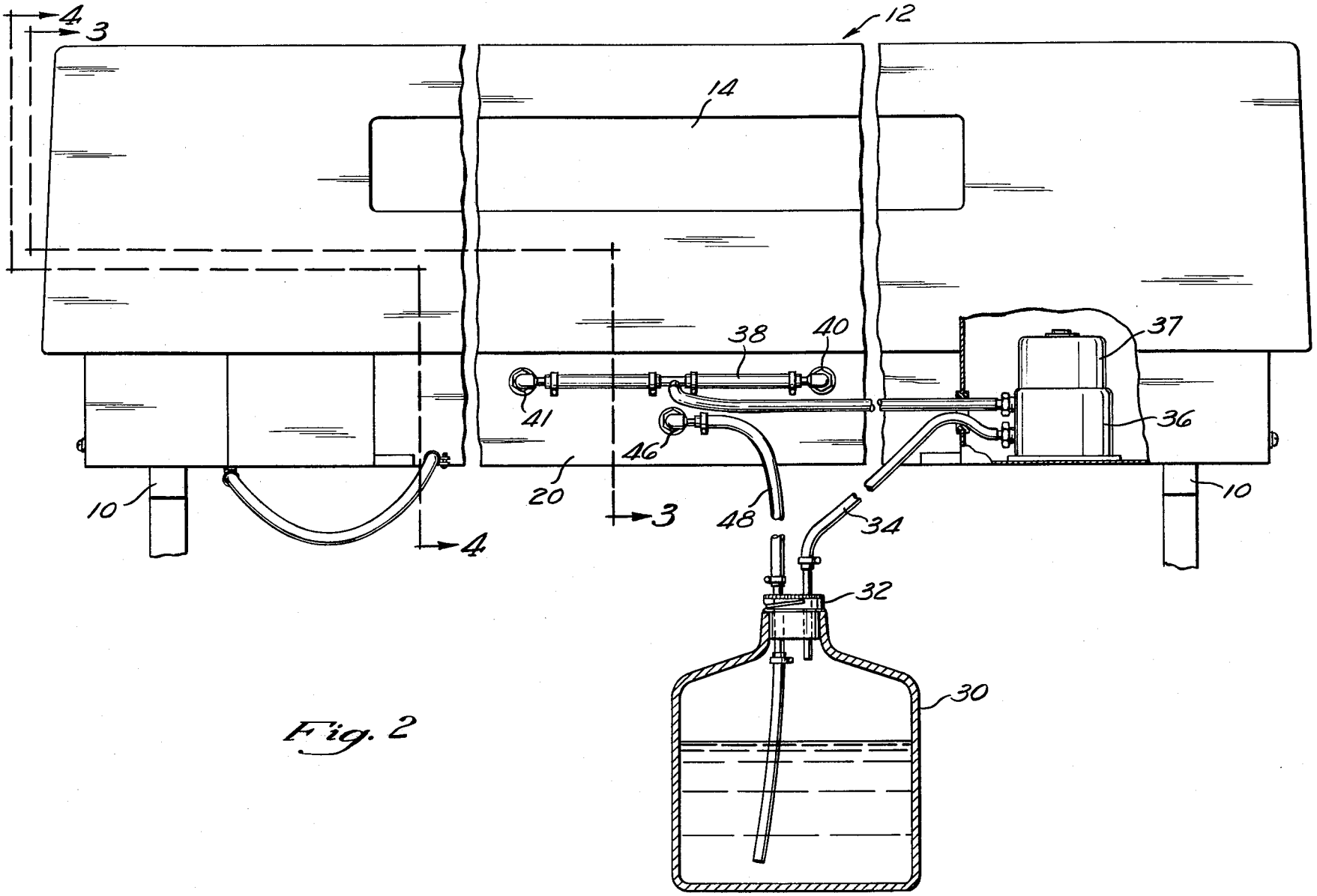
FIG. 2 is a condensed rear elevation, with parts of the housing broken away, of a diazo print machine embodying the present invention.
Figure 3:
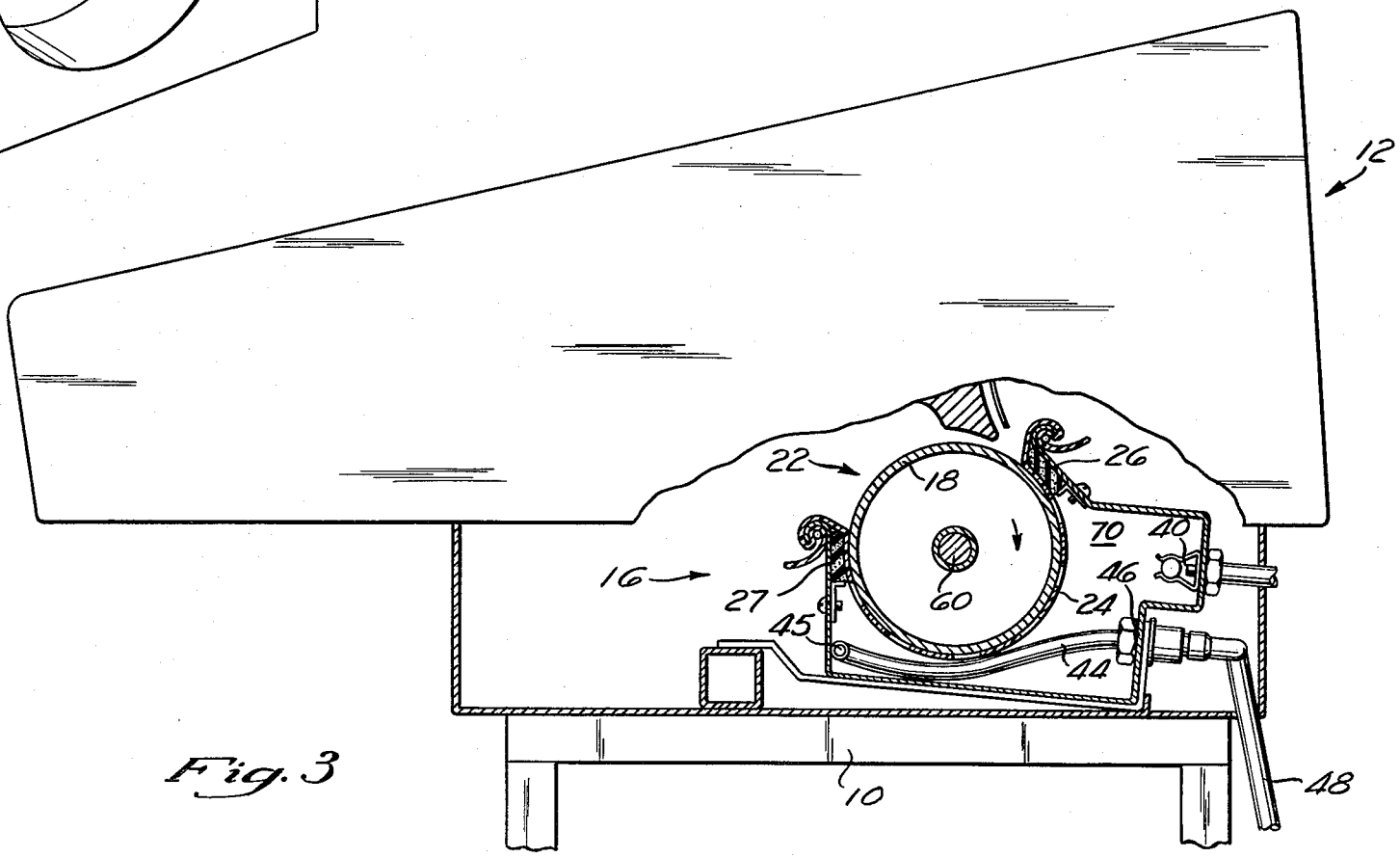
FIG. 3 is an end elevation, partially in section, taken substantially on line 3—3 of FIG. 2.

The diazo copier according to the present invention comprises a support frame 10 on which is mounted a housing 12, the upper portion of which encloses an exposure assembly 14 of any convenient construction. The lower portion of the housng encloses a development assembly 16 including a rotatably driven hollow transport drum or roll 18 suitably supported for rotation in any conventional manner, and driven in a customary way by a chain drive and or gearing from an electric motor (not shown).

Cooperating with the roll 18 is a development chamber 20. The development chamber is an elongate light weight sheet metal container which fits loosely and removably within the housing 12 and has an elongate mouth running lengthwise of the container. Across the mouth is draped an elongate sheet of flexible antifriction plastic, e.g. "Teflon," 24 provided with many perforations and fastened at its margins to the lips of the mouth together with parallel longitudinal resilient sealing strips 26 and 27. The walls of chamber 20 are resilient, and the assembly (including the walls adjacent the mouth 22, the sheet 24, and the sealing strips 26, 27) is so configured and dimensioned that the walls will give and allow the roll 18 to enter between the lips and be grasped thereby with the sheet 24 lying snugly against the roll surface and embracing slightly more than a semicircumference thereof.

Figure 5:
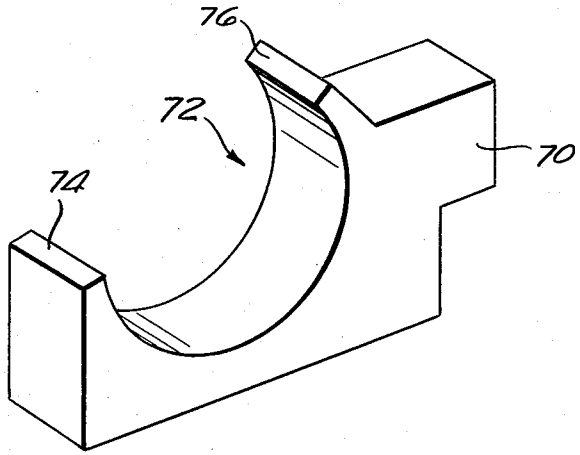
FIG. 5 is a perspective view of one of the sealing cuffs in the development chamber.

Against the inner surface of each end wall of the development chamber is a block of compressible sealing material configured generally like the outline of the container end wall. One of these blocks is shown in FIG. 5 and designated by numeral 70. The other is identical with it, and each is perhaps three-fourths of an inch in thickness. Each block 70 has a recess 72 of a size to snugly embrace slightly more than one-half of the circumference of a smooth bond at the corresponding end of the roll. The tips 74 & 76 of the blocks adjacent the recess 72 compressively abut the edges of the sealing strips 26, 27. Thus the two blocks 70 provide end sealing cuffs for the chamber adjacent the roll 18 and in cooperation with the sealing strips 26, 27 assure a reliable seal at the housing opening against the transport roll 18.

When the chamber 20 is installed it is merely snapped over the roll 18 and is primarily supported thereby. The dimensions and configuration of the chamber 20 are such, in relation to the machine housing, that rotation of the chamber with the roll is prevented.

When the device is in use, a copy sheet C is fed downwardly from the exposure assembly 14 with the lead edge entering between the roll 18 and the plastic sheet 24 and, with its light sensitive coating turned towards the plastic sheet. The rotation of the roll causes the sheet to progress along with the roll and with its sensitized surface sliding against the stationary sheet. Thus the copy sheet areas are progressively brought into contact with the ammonia gas within the chamber via the sheet perforations.

The means for supplying ammonia gas to the chamber 20 comprises a reservoir 30 partially filled with aqueous ammonia 32, above which is an atmosphere of fairly concentrated anhydrous ammonia which is continually being replenished by release of the gas from the solution. Passing through a sealing cap 32 on the reservoir is an ammonia supply tube 34 which does not reach the surface of the liquid and which conducts anhydrous ammonia gas to the intake port of a pump 36 conventionally powered by an electric motor 37. The pump's discharge port is connected by a tube system 38 with inlet fittings 40 and 41 in a wall of the development chamber 20 to feed gas to the interior thereof when the pump is operating during development of a copy sheet.

A gas return system includes a pipe 44 mounted within the chamber 20 with an open portion 45 which may be either an open end or a manifold section with plural openings spaced along the roller 18. The open portion occupies a gas outlet location remote from the inlet fittings and so positioned that the gas, in proceeding from the inlet fittings to the outlet opening or openings will follow a path which will cause it to impinge upon the plastic sheet 24 and, via the openings therein, against the sensitized surface of a copy sheet being developed on the surface of the transport roll 18. The pipe 44 connects with a fitting 46 in the chamber wall which connects with a return conduit 48 leading through the sealing cap 32 of the reservoir 30 and ending beneath the surface of the aqueous ammonia in the reservoir. Thus the returning gas is bubbled through the aqueous ammonia agitating the same and allowing reabsorption of a portion of any ammonia gas present in the returning flow.

In order to promote rapid and uniform development of the copy sheets, and particularly of copy sheets whose coatings are specially compounded to provide reliability and long shelf life, the system of the present invention also includes means to introduce moisture as a component of the development reaction. This is effected by providing means to maintain a pool 50 of water in the bottom of the development chamber. For this purpose there is provided an inlet fitting 52 which feeds the development chamber. The fitting is connected to a hose 54 connected with a water level gauge and filling cup 56 at the operator's side of the machine where the water can be conveniently replenished as required. A cover 58 protects the cup from foreign matter between inspections or replenishing operations which are infrequently required.

Finally, the most effective developing operation is accomplished by introducing a heater into the ambit of the developing chamber in order to promote vaporization of the water in the pool 50. In the form of the device shown there is an elongate heater element 60 which is stationarily mounted interiorly of the roll 18 and extending along its axis. The element may be supported in any convenient manner as by an energizing electric receptacle at one end and any suitable mechanical support at the other.

When arranged in this fashion, the heat provided by the element 60 not only promotes vaporization of the water in pool 50, but also, by heating the back surface of each copy sheet as it passes through the chamber, helps to deter the sheet from absorbing excessive moisture and thereby helps to maintain the strength and stiffness of the sheet for easy handling as it exits from the development treatment.

What is claimed is:

1. Apparatus for developing diazo copy sheets comprising:

walls defining a developing chamber for containing gaseous ammonia; said chamber being provided with an opening at one side;

transport means in proximity to said opening generally providing a closure for the same, and active to move a copy sheet into and out of developing contact with the gaseous ammonia with the sensitive surface of the copy sheet directed towards the interior of said chamber and the supporting layer of the copy sheet in contact with the transport means;

sealing means between the surface of said transport means and the margins of said opening for substantially confining the gaseous content within the chamber and maintaining sustantially the pressure conditions within the chamber under circumstances of the relative sliding movement between the surface of said transport means and the margins of said opening to provide a substantially sealed development chamber; and means for supplying ammonia gas to the chamber consisting essentially of:

a. a sealed reservoir for containing a liquid ammonia solution filling the container up to a level within a predetermined normal liquid level range, b. a supply conduit leading from the upper portion of said reservoir above the normal liquid level range to said development chamber, c. a pump in said supply conduit for moving the gas in said upper portion towards the development chamber, and d. a return duct leading from the development chamber to a point in the reservoir beneath the normal liquid level range.

2. Developing apparatus as set forth in claim 1 in which the transport means is a roll, and in which the sealing means between the roll and the chamber opening comprises resilient lips on those margins of the opening parallel to the roll axis, and a sealing cuff of resilient, compressible material at each end of the roll within the chamber and conformed to snugly embrace that portion of the roll entering the chamber.

3. Developing apparatus as set forth in claim 1 which further includes means for introducing moisture into the development chamber; and heating means associated with and so positioned with respect to the transport means as to direct its heating effect predominantly against the supporting layer of the copy sheet to prevent undue absorption of moisture thereby.

4. Apparatus for developing diazo copy sheets comprising:

walls defining a developing chamber for containing gaseous ammonia:

means for progressively presenting the surface of a copy sheet to the ammonia within the chamber; and means for supplying ammonia gas to the chamber consisting essentially of:

a. a sealed reservoir for containing a liquid ammonia solution filling the reservoir up to a level within a predetermined normal liquid level range, b. a supply conduit leading from the upper portion of said reservoir above the normal liquid level range to said development chamber, c. a pump in said supply conduit for moving the gas in said upper portion towards the development chamber, d. a return duct leading from the development chamber to a point in the reservoir beneath the normal liquid level range, and e. means for establishing and maintaining a pool of water in said development chamber, said means comprising a water level checking and replenishment cup readily accessible to the operator and connected by a conduit with said development chamber.

5. Developing apparatus as set forth in claim 4 in which heating means is associated with the chamber in such manner as to provide a heating effect within the chamber to promote vaporization of the water in the pool.

6. Apparatus for developing diazo copy sheets which includes walls defining a developing chamber for containing an ammonia charged atmosphere to develop diazo copy sheets; transport means having a substantially sealed relationship with an opening in the chamber walls for progressively presenting a copy sheet to the gaseous ammonia within the chamber; and means for establishing a pool of water in said developing chamber which means comprises a water level checking and replenishment cup readily accessible to the operator and connected by a conduit with said development chamber.

7. Developing apparatus as set forth in claim 6 in which heating means is provided within the transport roll to cause a heating effect within the chamber to promote vaporization of the water in the pool and to deter absorption of undue moisture by a copy sheet carried by the roll.

8. Developing apparatus for developing diazo copy sheets comprising:

a development chamber for containing an ammonia charged atmosphere to develop diazo copy sheets;

a transport roll for receiving a copy sheet on its exterior surface for movement through the development chamber with the sensitive surface of the sheet outwardly directed for direct exposure to the ammonia charged atmosphere in the development chamber;

means for establishing a pool of water in said developing chamber exteriorly of said roll; and heating means within the transport roll for exerting an outwardly going thermal pressure against the copy sheet to deter undue moisture absorption by the copy sheet during development while simultaneously promoting release of water vapor from said pool to augment development.

* * * * *